US006092336A

United States Patent [19]

Wright et al.

[11] Patent Number: 6,092,336

[45] Date of Patent: Jul. 25, 2000

[54] POWER LIFTGATE CABLE DRIVE WITH POSITION STOP

[75] Inventors: Kevin Wright, Detroit; William L. Priest, Royal Oak, both of Mich.

[73] Assignee: Delphi Technologies, Inc., Troy, Mich.

[21] Appl. No.: 09/248,618

[22] Filed: Feb. 11, 1999

[51] Int. Cl.[7] ..... E05F 11/24

[52] U.S. Cl. ..... 49/339; 49/340; 192/48.2; 296/56

[58] Field of Search ..... 49/339, 340, 341, 49/352, 348; 192/48.2, 48.92; 296/146.8, 56

[56] References Cited

U.S. PATENT DOCUMENTS

| | | | |
|---|---|---|---|
| 3,675,747 | 7/1972 | Obermark | 192/48.2 |
| 3,713,472 | 1/1973 | Dozois | 49/340 X |
| 3,735,840 | 5/1973 | Sheperd | 49/379 X |
| 4,851,742 | 7/1989 | Chapman . | |
| 5,279,399 | 1/1994 | Riggle . | |
| 5,279,400 | 1/1994 | Riggle et al. . | |
| 5,448,856 | 9/1995 | Moore et al. . | |
| 5,531,498 | 7/1996 | Kowall . | |
| 5,588,258 | 12/1996 | Wright et al. . | |

*Primary Examiner*—Jerry Redman
*Attorney, Agent, or Firm*—Kathryn A. Marra

[57] ABSTRACT

A vehicle power liftgate cable drive has a cable drive housing. An electric motor with a motor housing and an output shaft is secured to the cable drive housing. A clutch pack with a first clutch driven by the output shaft and a second clutch driven by the first clutch, is mounted in the cable drive housing. One of the clutches in the clutch pack is a one way clutch and the other clutch is an electromagnetic clutch. A pinion gear is driven by the second clutch. An output gear is rotatably journaled on a fixed shaft and driven by the pinion gear. The cable drum is attached to the output gear. A coil spring has one end fixed to the fixed shaft and its other end attached to the cable drum. The fixed shaft is rotated to preload the coil spring in a direction that tends to wind a cable on the cable drum and then the fixed shaft is fastened to the cable drive housing. A cable is attached to the cable drum and to the liftgate. A solenoid plunger cooperates with the output gear to stop the liftgate in an intermediate position.

5 Claims, 3 Drawing Sheets

POWER LIFTGATE CABLE DRIVE WITH POSITION STOP

TECHNICAL FIELD

This invention relates to a system for opening and closing liftgates on vehicles and more particularly to a cable drive unit for taking in and letting out a cable that closes and opens a liftgate or other vehicle hatch.

BACKGROUND OF THE INVENTION

Liftgates and other doors on vans and other utility vehicles are large and heavy. Their weight is increased by windows, window wipers, defoggers and other equipment. Their hinges with a horizontal pivot axis at the top of the liftgate cause a fully open liftgate to be above the reach of many people. Power liftgate opening and closing systems are needed to reduce the effort required to manually open and close heavy liftgates. Power closing systems are also needed by all but the tallest people to close liftgates that are above their reach.

A number of power systems have been proposed for opening and closing vehicle liftgates. These systems include complicated linkages in combination with a manual window crank mechanism. Such linkage systems are slow, require substantial effort to use and are unreliable.

Automotive deck lid closures with gear trains, gear racks and drive pinions have been proposed. Such systems are heavy, expensive and require a substantial amount of space.

Cable drives have been proposed for use on vehicle liftgates as well as on truck or deck lids. These units generally have not maintained tension on the cables. When cables become slack they can get kinks, catch on cargo in the vehicle, become misrouted and have limited control over the position of open liftgates and deck lids. Manual opening and closing is difficult at best and operation during a vehicle electrical failure may be impossible.

SUMMARY OF THE INVENTION

An object of the invention is to provide a single cable liftgate opening and closing system that maintains cable tension at all time.

Another object of the invention is to provide a single cable liftgate opening and closing system that is ready for manual operation any time current is shut off.

A further object of the invention is to provide a single cable liftgate opening and closing system that is not damaged when the liftgate contacts an obstruction during opening or closing.

A still further object of the invention is to provide a powered single cable liftgate opening and closing system that can be overridden manually any time during operation or when the system is turned off.

Yet another object of the invention is to provide a single cable liftgate opening and closing system that can be stopped during an opening operation to hold the liftgate in an intermediate position.

The system has a cable drive that is driven by a permanent magnet direct current motor through a reduction gear train. The output shaft of the motor drives a clutchpack with two clutches in series. One of the clutches is a one way roller clutch. The other clutch is an electromagnetic clutch. As described below, the electric motor drives a one way roller clutch that drives the electromagnetic clutch. The clutches can be switched so that the one way roller clutch is driven by the electromagnetic clutch.

The clutch pack drives a pinion gear that drives an output gear. The output gear is journaled on a fixed shaft. A cable drum is an integral part of the output gear or is attached to the output gear. Intermediate gears can be used if the two gears do not provide the required gear ratio.

A coil spring is mounted inside the cable drum. The inner end of the spring is attached to the fixed shaft. The outer end of the coil spring is anchored in a groove inside the cable drum. A preload is placed on the coil spring by rotating the fixed shaft in a direction that tends to wind a cable up onto the cable drum and then locking the fixed shaft to the housing.

An encoder disc with apertures is integral with the pinion gear. A slotted optical sensor straddles the encoder disc and sends disc speed signals to a controller.

The cable drive includes a stop assembly that locks the cable drum in place during the opening operation to hold the liftgate in an intermediate position.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
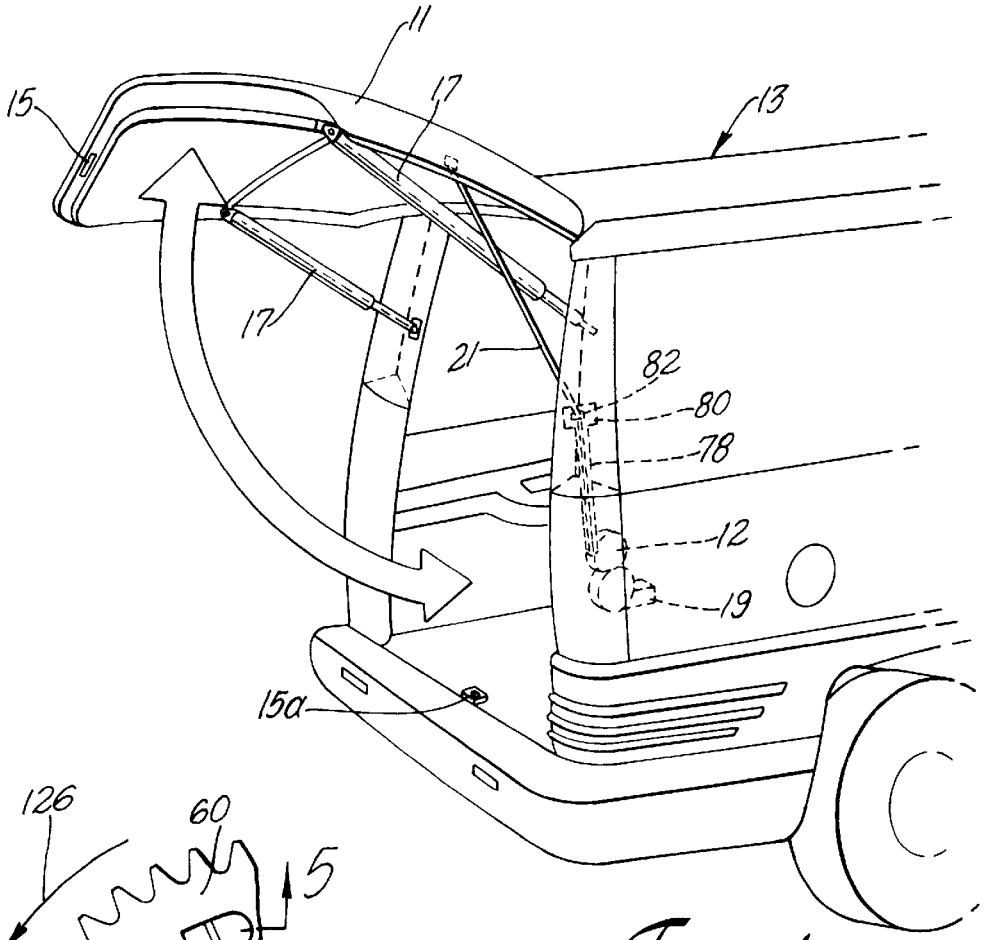
FIG. 1 is a perspective view of the aft end of an automotive van equipped with a power liftgate operating system of the invention.

The invention is disclosed in connection with a power liftgate operating system that opens and closes a hatch or liftgate 11 of a vehicle 13. The system includes a cable drive unit 10 in accordance with the invention, a latch 15, a striker 15*a*, a counter balance system 17, an electronic controller 19 and an obstruction sensing system.

Counter balance system 17 comprises two gas struts that are arranged to open liftgate 11 whenever liftgate 11 is unlatched. The force of the gas struts opening liftgate 11 preferably exceed the force required to open the liftgate by a relatively constant amount throughout the fall range of movement between a closed position and a fully open position.

Latch 15 cooperates with striker 15*a* to latch liftgate 11 in a fully closed position. Such latches are well known and need not be explained in detail. Latch 15 is preferably a power unlatching and cinching latch of the type that is on vehicle liftgates. These latches allow the liftgate to be closed gently to a partially closed position. The latch then automatically moves the liftgate to a fully closed position compressing the liftgate seals in the process. Liftgate 11 is released by activation of a power unlatching system that releases a detent in the latch which allows the compressed seals to expand and push the latch free of the striker. Liftgate 11 is then opened by the gas struts of the counterbalance system 17.

The liftgate cable drive unit 10 of the invention controls the rate of movement of the liftgate as it is opened by the counter balance system 17. The cable drive unit 10 also moves the liftgate 11 from a fully open position or any partially open position to a fully closed position or alternatively to a partially closed position where a power unlatching and cinching latch 15 engages striker 15*a* and then automatically completes closure compressing the liftgate seals and latching the liftgate in the fully closed position.

Figure 2:
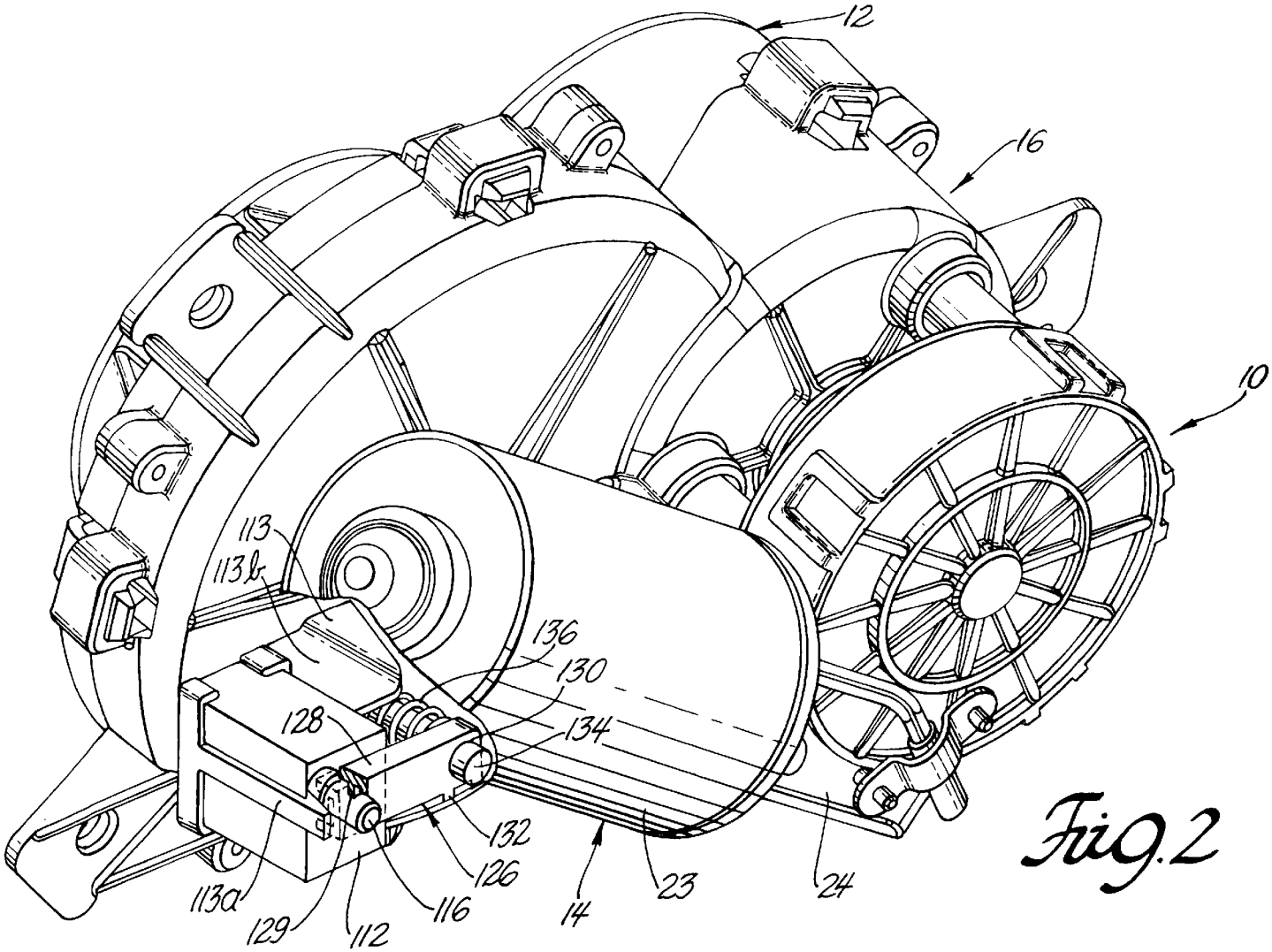
FIG. 2 is a perspective view of the cable drive unit of the system shown in FIG. 1.
Figure 3:
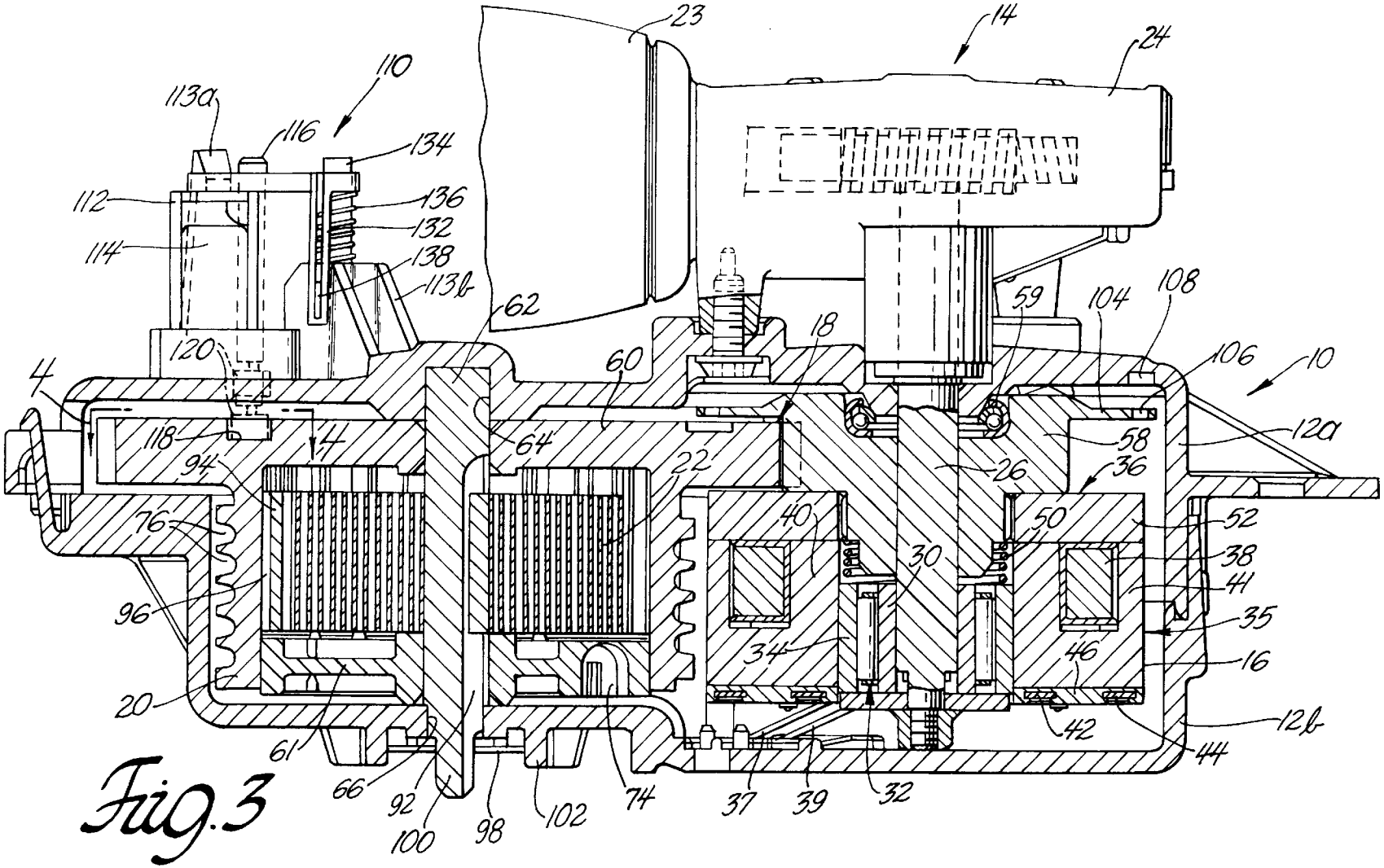
FIG. 3 is a sectional view of the cable drive unit taken in a plane through the axis of the motor output shaft and through the axis of the cable drum shaft.

Referring now to FIGS. 2 and 3, the cable drive unit 10 includes a cable drive unit housing 12, a motor assembly 14, a clutch pack 16, a gear train 18, a cable drum 20, a cable 21, and a cable return spring 22. The drive unit housing 12 comprises a base 12*a* and a cover 12*b* of molded plastic material. Cover 12*b* has a plurality of locking prongs 12*c* to lock cover 12*b* to base 12*a*.

Motor assembly 14 includes a permanent magnet direct current motor 23, a right angled reduction gear set in a housing 24 and an output shaft 26. Electric motor 23 is reversible. Speed of motor 23 can be controlled in any suitable manner for instance by pulse width modulation of the current to the motor. Gear housing 24 is connected to the base 12*a* of the drive unit housing 12 by mechanical fasteners.

Clutch pack 16 includes a pair of clutches, in series with each other, that transmit torque to and from the output shaft 26. The first clutch 28 of the clutch pack 16 is a one-way or overrun clutch that transmits torque in one direction only. Such clutches are well known and need not be explained in detail. See for instance, U.S. Pat. Nos. 5,279,399 and 5,279,400.

Clutch 28 has an inner race 30 that is pressed onto the output shaft 26 of motor assembly 14 and an outer cylindrical surface that is concentric with the output shaft 26. A roller pack 32 is disposed between inner race 30 and an outer race 34 that has a ramped inner surface. Roller pack 32 comprises a cage, a plurality of rollers that are disposed in windows of the cage and springs that bias the rollers toward wedging engagement between the races 30 and 34. Roller pack 32 thus allows inner race 30 to rotate in one direction relative to outer race 34 and locks the races 30 and 34 together to transmit torque in the other direction.

The second clutch 36 of the clutch pack 16 is an electromagnetic clutch with a coil 38 between two concentric iron collars 40 and 41. These iron collars are the radially spaced legs of a ring shaped member 35 that has a U-shaped cross section as shown in FIG. 3. Outer race 34 of one-way clutch 28 is pressed into inner collar 40 of member 35. Two electrical contact rings 42 and 44 are connected to a non-conductor 46. The non-conductor 46 separates the contact rings 42 and 44 from the ring shaped member 35 and from each other. The contact rings 42 and 44 are each connected to one of the leads on the coil 38. Clutch terminals 37 and 39 each contact one of the contact rings 42 and 44 and are connected to controller 19.

A compression spring 50 is disposed inside inner collar 40 to bias a friction plate 52 away from the ends of collars 40 and 41. When the coil 38 of electromagnetic clutch 36 is energized through the clutch terminals 37 and 39 and electrical contact rings 42 and 44, the friction plate 52 is drawn into contact with the ends of collars 40 and 41 by the magnetic field that is created. The contact between the friction plate 52 and the ends of collars 40 connects the second electromagnetic clutch 36 to the friction plate 52. However, torque is transmitted between the output shaft 26 and the friction plate 52 only when the torque is in the direction which engages the overrun clutch 28 and the second clutch 36 is energized. When current to the electrical contact rings 42 and 44 is discontinued the magnetic field is discontinued and the spring 50 disengages the friction plate 52 from the collars 40 and 41 of ring shaped member 35.

The friction plate 52 has internal splines that engage external splines of a pinion gear 58 that is rotatably journaled on the output shaft 26 of the motor assembly 14. A ball thrust bearing 59 holds the pinion gear 58 out of contact with the base 12*a* of housing 12.

Pinion gear 58 meshes with an output gear 60 of drive train 18 that is journaled on an adjustable, fixed shaft 62. One end of shaft 62 is journaled in a bore 64 in base 12*a* and the other end is journaled in bore 66 of cover 12*b*. The axis of shaft 62 is parallel to and offset from the axis of output shaft 26.

Cable drum 20 may be an integral part of output gear 60 as shown in FIG. 3. Alternatively, cable drum 20 may be made as a separate piece and attached to output gear 60 for rotation with the output gear. A cover 61 is secured to the hollow cable drum 20 to close the open end. Cover 61 has a cable anchor pocket 74 for connecting cable 21 to cable drum 20. Cable drum 20 has a spiral cable groove 76 in its outer peripheral surface that is sufficient to store cable 21 wound on the cable drum 20 during a little more than four revolutions of the cable drum. The cable drum 20 can be enlarged if additional cable 21 is required.

A cable sheath 78 may be attached to the drive unit housing 12 and extend outward to a pulley housing assembly 80 that is attached to body structure of automotive van 13 and that includes a cable exit passage 82. The cable drive unit 10 is normally secured to the body structure inside the van and the exit passage 82 passes through a wall of the body structure so that the end of cable 21 can be attached to liftgate 11 as shown in FIG. 1. Exit passage 82 has dust and water seals that seal between exit passage 82 and cable 21. A pulley (not shown) is provided in pulley housing assembly 80 to accommodate a change in direction of cable 21 and align cable 21 with the exit passage 82. Sheath 78 protects cable 21 inside the body structure. Pulleys are preferably used to guide cable 21 even if sheath 78 is not used.

Tension is applied to cable 21 at all times to prevent the cable from becoming misrouted, from disengaging from a pulley, from catching on something or from becoming kinked. Tension is maintained on cable 21 by a cable return coil spring 22. An inner end 90 of the coil spring 22 is received in a slot 92 in the fixed shaft 62. The outer end 94 of the coil spring 22 engages a recess 96 in the inside of the cable drum 20. The coil spring 22 is pretensioned when the cable 21 is wound onto the cable drum 20 by rotating the fixed shaft 62, in the direction that winds cable 21 onto cable drum 20, one revolution for each rotation of the cable drum required to retract the cable plus three additional revolutions. As described above the fixed shaft 62 is rotated seven revolutions if the liftgate is open or three revolutions if the liftgate is closed and the cable 21 is wound up in groove 76. After the spring 22 is properly tensioned, the fixed shaft 62 is locked in a fixed position by a U-shaped clip 98 that is slid around a square end 100 of the fixed shaft 62, that extends out of the housing 12, and into a clip pocket 102 in the housing cover 12*b*.

An interrupter plate 104 with apertures 106 is integral with the pinion gear 58. A sensor, illustrated schematically at 108, is mounted on the housing 12 adjacent to the apertures 106. Movement of the apertures 106 past the sensor 108 generates a signal that is proportional to the speed of rotation of the cable drum 20. The rotational speed signal is transmitted to the controller 19.

During operation, the liftgate 11 or other hatch is closed by running the reversible electric motor 23 in a direction that drives the pinion gear 58, the output gear 60 and the cable drum 20 so as to wind the cable 21 onto cable drum 20. Torque from the motor 23 is transmitted through the clutch 28 and clutch 36 to drive the pinion gear 58. If the liftgate is moved toward the closed position by an outside force faster than liftgate 11 is moved by motor 23, the one-way or overrun first clutch 28 will release and allow the coil spring 22 to rotate cable drum 20 in the wind-up direction and maintain tension on cable 21. When the power unlatching and cinching latch 15 engages striker 15*a*, the motor 23 is turned off and the liftgate 11 is automatically fully closed and cinched in the closed position. An obstruction that prevents the liftgate 11 from closing before latch 15 engages striker 15*a* causes the interrupter or encoding disc 104 to slow. The sensor 108 detects the change in the speed of the interrupter 104 and reverses motor 23 until liftgate 11 is reopened.

The closed liftgate 11 is opened by releasing the latch 15, energizing the electromagnetic clutch 36 and running the motor in a direction that unwinds the cable 21 from the cable drum 20. Torque from forces urging the liftgate to an open position is transmitted to the clutch pack 16, both the first clutch 28 and the second clutch 36 are engaged and the motor 23 becomes a brake and controls the speed of opening movement of the liftgate 11. An obstruction that prevents the liftgate from opening releases the overrunning clutch 28. Upon release of the overrunning clutch 28, the sensor 108 senses that the interrupter 104 has stopped and the electric motor 23 is turned off. The electromagnetic clutch 36 is also deenergized and disengaged. An outside force tending to open the liftgate faster than the motor 23 allows increases the torque on the motor. The increase in torque due to an outside force trying to open the liftgate faster than permitted by the cable drive unit speeds up the pinion gear 58. The increase in the speed of the pinion gear 58 is sensed by the interrupter 104 and the sensor 108. The controller 19 is generally programmed to continue to open the liftgate 11 at the original rate. However it could disengage the electromagnetic clutch 36 if desired.

The electromagnetic clutch 36 is disengaged any time the cable drive unit 10 is turned off or there is a failure in the electrical system that prevents the supply of sufficient voltage to the cable drive unit 10. When the second clutch 36 is disengaged, the liftgate can be opened and closed manually. The cable 21 is pulled out and unwound from the cable drum 20 during manual opening. The cable drum 20 is rotated by the cable return spring 22 and the cable 21 is wound up onto cable drum 20 during manual closing of the liftgate.

Cable 21 is preferably attached to liftgate 11 at a location that minimizes the change in the length of the moment arm for the force exerted by the cable 21 from the liftgate closed to the liftgate fully opened positions. Minimizing changes in the length of the moment arm reduces changes in the force exerted by cable 21. The reduction in changes in the force exerted by the cable 21 makes control of the cable drive unit 10 more accurate.

The cable drive unit 10 also includes a stop assembly 110 so that liftgate 11 can be stopped and held in an intermediate position between the lowered, fully closed or partially closed position and the raised open position.

Figure 4:
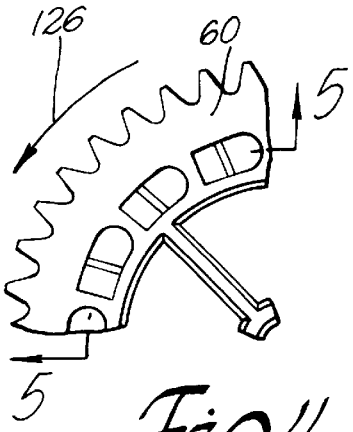
FIG. 4 is a sectional view taken substantially along the line 4—4 of FIG. 3 looking in the direction of the arrows.
Figure 5:
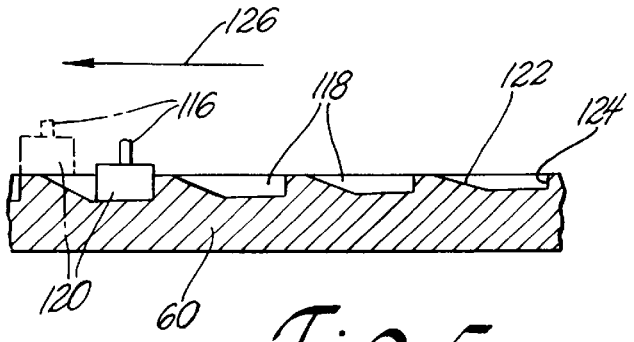
FIG. 5 is a sectional view taken substantially along the line 5—5 of FIG. 4 looking in the direction of the arrows.

Stop assembly 110 comprises a housing 112 that is attached to base 12*b* of housing 12 by a bracket 113 that includes a latch arm 113*a* and a post support 113*b*. Housing 112 holds a solenoid 114 which includes plunger 116 that protrudes through a hole in housing base 12*b* and engages a face of output gear 60 as best shown in FIGS. 3, 4 and 5. Output gear 60 has a circumferential array of detents 118 as best shown in FIGS. 4 and 5. The lower tip 120 of plunger 116 is a right circular cylinder while each detent 118 has a cam surface 122 that leads to a stop shoulder 124 so that output gear 60 cannot rotate counterclockwise when plunger 116 is extended as indicated by arrow 126 in FIGS. 4 and 5. When plunger 116 is extended, tip 120 quickly engages one of the stop shoulders 124 and prevents output gear 60 from being driven in the counterclockwise direction. This is the liftgate opening direction or cable unwinding direction.

Stop assembly 110 further includes a retainer 126 that has a slide 128 at one end, a post hole 130 at an opposite end and a latch arm 132. Stop assembly 110 also includes a post 134 that is mounted in post support 113*b* of bracket 113 and a return spring 136 that surrounds the upper end of post 134.

Retainer 126 is attached to the upper end of plunger 116 by slide 128. The upper end of plunger 116 has a slot that receives a rail 129 in the slide 128 when slide 128 is attached so that retainer 126 rises and falls with plunger 116.

When retainer 126 is attached, post hole 130 fits onto the upper end of post 134 and engages the upper end of return spring 136 so that spring 136 biases retainer 126 and plunger 116 upwardly as shown in FIG. 3.

Latch arm 132 snaps over detent 138 to hold retainer 126 and plunger 116 at their upper limit.

Stop assembly 110 operates during the liftgate opening operation to stop and hold the liftgate 11 in an intermediate position as follows. After latch 15 is released, the electromagnetic clutch 36 and the electric motor 23 are energized in the normal manner to run the electric motor 23 in a direction that rotates cable drum 20 in a direction that unwinds cable 21 from cable drum 20, i.e., counterclockwise as shown in FIGS. 4 and 5. Liftgate 11 is then urged toward the raised open position by the counter balance system 17 with electric motor 23 acting as a brake to control the speed of movement of liftgate 11. Liftgate 11 may now be stopped in any intermediate position by energizing solenoid 114 which moves plunger 116 from the retracted position shown in dashed lines in FIG. 5 toward the extended position shown in solid line against the bias of return spring 136. As output gear 60 rotates counterclockwise, tip 120 quickly rides down one of the cam surfaces 122 and engages a stop shoulder 124. This stops counterclockwise rotation of output gear 60 and holds liftgate 11 in an intermediate position releasing overrun clutch 28. Sensor 108 senses that interrupter 104 has stopped and sends a signal to controller 19 which turns electric motor 23 off and deenergizes clutch 36 and solenoid 114. However, plunger 116 does not retract because the gas cylinders of counterbalance system 17 hold shoulder 124 against tip 120 by maintaining tension on cable 21 which biases drum 30 in the counterclockwise direction indicated by arrow 126 in FIGS. 5 and 6. Controller 19 is programmed to recognize the original actuation of solenoid 114 and does not reverse electric motor 23.

Liftgate 11 can then be raised to a fully opened position or lowered to a fully closed or nearly closed position at a later time. This is done by moving liftgate 11 a small distance toward the closed direction either manually or electrically. This releases tip 20 of plunger 116 so that spring 136 retracts plunger 116 and frees output gear 60 for rotation by electric motor 23. Motor 23 is then energized to pull liftgate 11 down toward the closed position or to brake liftgate 11 as it is being pushed up by counterbalance 17.

The disclosed embodiment is representative of a presently preferred form of the invention, but is intended to be illustrative rather than definitive thereof The invention is defined in the claims.

We claim:

1. A vehicle power liftgate cable drive comprising:

an electric motor having an output shaft, a clutch pack including a first clutch driven by the output shaft, a second clutch driven by the first clutch and wherein one of said first clutch and said second clutch is a one way clutch and the other of said first clutch and said second clutch is an electromagnetic clutch;

a cable drum driven by the second clutch;

a cable connected to and driven by the cable drum and connected to a vehicle power liftgate; and a stop interrupting movement of the cable drum in a first direction to hold the liftgate in an intermediate position.

2. The vehicle power liftgate cable drive as defined in claim 1 wherein the stop comprises a solenoid plunger.

3. A vehicle power liftgate cable drive comprising:

a cable drive housing;

an electric motor having an output shaft, a clutch pack including a first clutch driven by the output shaft, a second clutch driven by the first clutch and wherein one of said first clutch and said second clutch is a one way clutch and the other of said first clutch and said second clutch is an electromagnetic clutch;

a pinion gear driven by the second clutch;

an output gear driven by the pinion gear;

a cable drum driven by the output gear and journaled on a fixed shaft journaled in the cable drive housing;

a cable connected to and driven by the cable drum and connected to a vehicle power liftgate, a spring connected to the fixed shaft and to the cable drum; and a mechanical fastener connected to the cable drive housing and the fixed shaft that holds the fixed shaft in a position in which the spring biases the cable drum in a direction that urges the cable drum to rotate in a direction that winds the cable onto the cable drum, and a stop selectively interrupting movement of the cable drum when the cable drum rotates in an opposite direction.

4. The vehicle power liftgate cable drive as defined in claim 3 wherein the stop comprises a solenoid plunger and a plurality of stop shoulders on the output gear.

5. The vehicle power liftgate cable drive as defined in claim 4 wherein the stop includes a retainer attached to the solenoid plunger, an offset post and a return coil spring that is disposed about the post and engaged by the retainer.

* * * * *